US007066017B2

(12) United States Patent
Kano et al.

(10) Patent No.: US 7,066,017 B2
(45) Date of Patent: Jun. 27, 2006

(54) METHOD OF DETECTING PRESSURE LEAKAGE IN EVAPORATED FUEL CONTROL SYSTEM FOR USE IN AUTOMOBILE

(75) Inventors: Masao Kano, Gamagori (JP); Kenji Nagasaki, Nagoya (JP)

(73) Assignee: DENSO Corporation, Kariya (JP)

( * ) Notice: Subject to any disclaimer, the term of this patent is extended or adjusted under 35 U.S.C. 154(b) by 177 days.

(21) Appl. No.: 10/270,155

(22) Filed: Oct. 15, 2002

(65) Prior Publication Data

US 2003/0084711 A1 May 8, 2003

(30) Foreign Application Priority Data

Nov. 7, 2001 (JP) ..... 2001-341379

(51) Int. Cl.
*G01M 15/00* (2006.01)

(52) U.S. Cl. ..... 73/118.1; 73/49.7

(58) Field of Classification Search ..... 73/39, 73/40, 46, 47, 49.7, 116, 117.2, 117.3, 118.1, 73/119 A See application file for complete search history.

(56) References Cited

U.S. PATENT DOCUMENTS 5,635,630 A * 6/1997 Dawson et al. ..... 73/40.5 R
5,890,474 A 4/1999 Schnaibel et al.
5,911,209 A 6/1999 Kouda et al.
2002/0035990 A1 * 3/2002 Yoshida et al. ..... 123/520
2002/0139173 A1 * 10/2002 Kano et al. ..... 73/49.7
2003/0051540 A1 * 3/2003 Morinaga et al ..... 73/118.1
2003/0051541 A1 * 3/2003 Kano et al. ..... 73/118.1
2003/0074958 A1 * 4/2003 Nagasaki et al. ..... 73/118.1

FOREIGN PATENT DOCUMENTS

JP 3-277884 12/1991
JP 7-280126 10/1995
JP 2001-82261 3/2001

* cited by examiner

*Primary Examiner*—Eric S. McCall
(74) *Attorney, Agent, or Firm*—Nixon & Vanderhye P.C.

(57) ABSTRACT

Pressure leakage in an evaporated fuel control system having a canister for absorbing evaporated fuel in a fuel tank is detected after an engine is stopped and a temperature in the system is stabilized. In the leakage detecting process, communication between the system and an atmospheric pressure is shut-off by closing an electromagnetic valve connected to the canister. The electromagnetic valve is closed by once supplying a full voltage thereto, and the closed-state is maintained by intermittently supplying a voltage in a duty-ratio-controlled manner or by supplying a lower voltage. Thus, power consumption for maintaining the closed-state is reduced.

10 Claims, 3 Drawing Sheets

METHOD OF DETECTING PRESSURE LEAKAGE IN EVAPORATED FUEL CONTROL SYSTEM FOR USE IN AUTOMOBILE

CROSS-REFERENCE TO RELATED APPLICATION

This application is based upon and claims benefit of priority of Japanese Patent Application No. 2001-341379 filed on Nov. 7, 2001, the content of which is incorporated herein by reference.

BACKGROUND OF THE INVENTION

1. Field of the Invention

The present invention relates to a method of detecting leakage in a system for absorbing evaporated fuel from a fuel tank and for purging the absorbed fuel into an intake pipe of an internal combustion engine mounted on an automobile. The detection of the leakage is performed after the engine is stopped.

2. Description of Related Art

An evaporated fuel control system, in which fuel evaporated from a fuel tank is absorbed to an absorbing material such as grain-shaped activated carbon, and the absorbed fuel is purged into an intake pipe of an engine by a negative pressure developed in the intake pipe, is known hitherto. In order to prevent fuel leakage from the system, it is necessary to detect pressure leakage in the system. In detecting the leakage, the system is closed from the atmospheric pressure. Then, an inner space of the system is pressurized by a pump, and a pressure therein is measured to detect the pressure leakage. Alternatively, the leakage is detected, without pressurizing the inner space, by comparing a measured pressure in the closed space with a predetermined pressure corresponding to an ambient temperature or a temperature in the inner space measured at that time.

In any case, communication between the system and the atmospheric pressure has to be shut-off to measure the inner pressure for detecting the pressure leakage. The communication with the atmospheric pressure is shut-off by turning on an electromagnetic valve disposed in the system. After the leakage detection is completed, the electromagnetic valve is turned off to establish again the is communication between the system and the atmospheric pressure. Since the leakage detection is performed while the engine is not operating, an on-board battery cannot be charged by a generator driven by the engine, and electric power for energizing the electromagnetic valve has to be supplied solely from the on-board battery. In addition, the electromagnetic valve has to be kept energized for a certain period of time until the pressure and temperature in the system is stabilized. Accordingly, the battery power is consumed in the process of detecting the pressure leakage.

SUMMARY OF THE INVENTION

The present invention has been made in view of the above-mentioned problem, and an object of the present invention is to provide an improved method of detecting a pressure leakage in the evaporated fuel control system, in which the battery power consumption is reduced.

The evaporated fuel control system includes a fuel tank, a canister communicating with the fuel tank, an electromagnetic valve for controlling communication between the canister and an atmospheric pressure, and a purge valve for purging the evaporated fuel into an automotive engine. Fuel evaporated in the fuel tank is absorbed to an absorbing material contained in the canister. The absorbed fuel is purged into an intake pipe of the engine by a negative pressure in the intake pipe.

A process for detecting pressure leakage in the system is performed after the engine is stopped and a temperature in the system is stabilized. In the detecting process, the system is isolated from outside by closing the electromagnetic valve and the purge valve. Communication between the canister and the atmospheric pressure is shutoff by energizing the electromagnetic valve, and communication between the fuel tank and the intake pipe is shut-off by the purge valve which is automatically closed when the engine is not operating.

Then, a pressure in the system is measured, and at the same time, an ambient temperature or a temperature in the system is measured. The measured pressure is compared with a predetermined normal pressure which is expected in the system having no leakage at the measure temperature. It is determined that there is pressure leakage in the system if the measured pressure is lower than the predetermined normal pressure.

For closing the electromagnetic valve in the leakage detecting process, a full voltage is once supplied to the electromagnetic valve, and then the voltage is intermittently supplied in a duty-ratio-controlled manner to maintain the shut-off state of the electromagnetic valve. Alternatively, the full voltage is reduced to a certain level which is able to maintain the shut-off state. Thus, electric power consumption for keeping the electromagnetic valve at the shut-off state is reduced.

Other objects and features of the present invention will become more readily apparent from a better understanding of the preferred embodiment described below with reference to the following drawings.

DETAILED DESCRIPTION OF THE PREFERRED EMBODIMENT

A preferred embodiment of the present invention will be described with reference to accompanying drawings. First, referring to FIG. 1, an entire structure of the evaporated fuel control system will be described. Evaporated fuel in a fuel tank 100 is absorbed to an absorbing material such as activated carbon contained in a canister 120. The absorbed fuel is purged into an intake pipe 130 of an internal combustion engine by a negative pressure in the intake pipe 130. Pressure leakage of the system is detected when the engine is not operating. A pressure in an inner space of the system is measured while communication between the system and atmospheric pressure is being shut-off. At the same time, an ambient temperature or a temperature in the inner space of the system is measured. The measured pressure is compared with a predetermined normal pressure corresponding to the measured ambient temperature or the inner space temperature. If the measured pressure is lower than the predetermined normal pressure, it is determined that there is a pressure leakage in the system.

Figure 1:
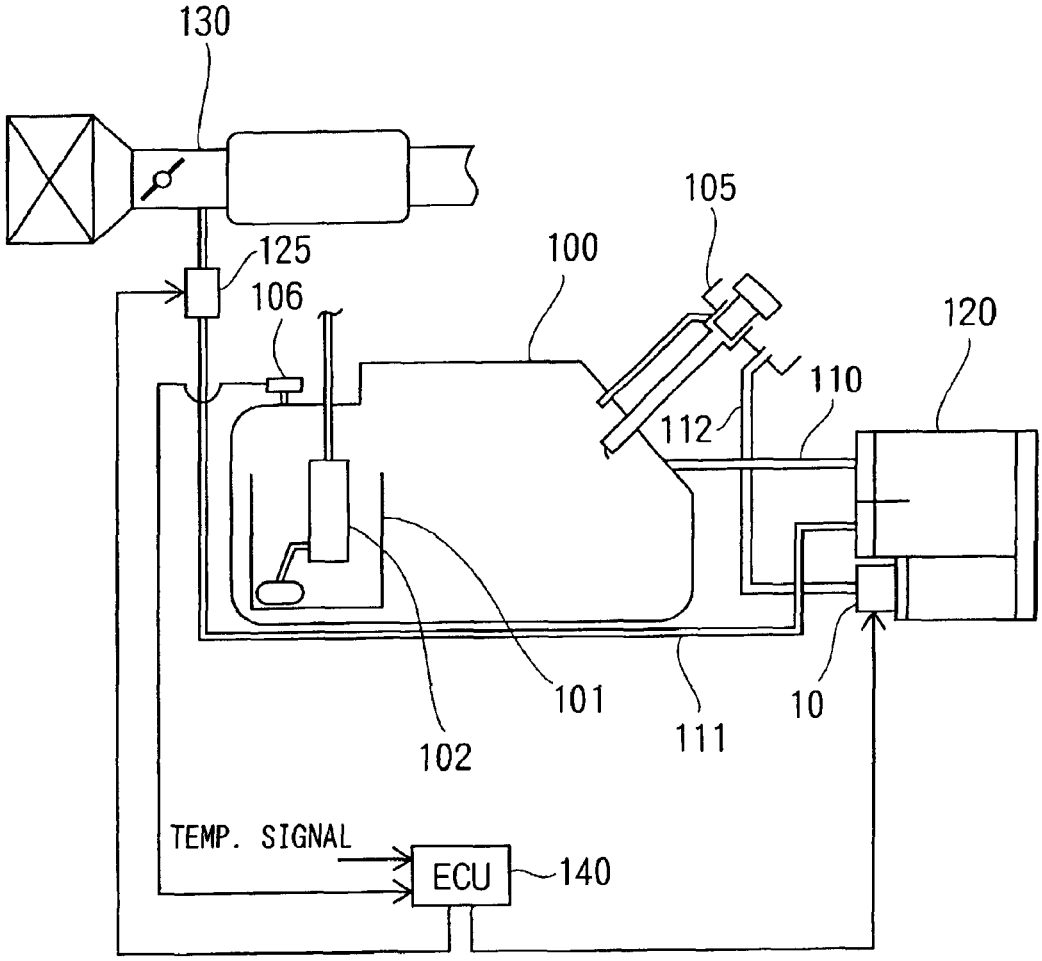
FIG. 1 shows an entire structure of an evaporated fuel control system.

As shown in FIG. 1, a sub-tank 101 is disposed in the fuel tank 100, and a fuel pump 102 that sucks fuel in the sub-tank 101 and supplies the sucked fuel to the engine is disposed in the sub-tank 101. The fuel tank 100 and the canister 120 are connected through a pipe 110, while the canister 120 and the intake pipe 130 are connected through a pipe 111. Thus, the fuel tank 100, the pipe 110, the canister 120 and the pipe 111 constitute an evaporated fuel passage. An inlet port 105 for charging fuel in the fuel tank 100 is connected to the fuel tank 100.

A pressure sensor 106 for measuring a pressure in the fuel tank 100 is connected to the fuel tank 100. An electrical signal indicating the pressure in the fuel tank 100 is fed from the pressure sensor 106 to an electronic control unit (ECU) 140. It is also possible to dispose the pressure sensor 106 in the evaporated fuel passage other than the fuel tank 100, as long as the pressure in the fuel passage can be measured. An electrical signal indicating an ambient temperature is fed to the ECU 140 from a temperature sensor (not shown). A purge valve 125, which is electromagnetically operated, is disposed in the pipe 111 to selectively open or close a fuel passage in the pipe 111.

An electromagnetic valve 10 is connected to the canister 120 to selectively open or close the canister 120 to the atmospheric pressure through a pipe 112. When the engine is operating, the electromagnetic valve 10 is turned off to thereby establish communication between the canister 120 and the atmosphere. Upon opening the purge valve 125 by supplying electric current thereto, while the engine is operating, evaporated fuel absorbed to the absorbing material contained in the canister 120 is purged into the intake pipe 130 through the purge valve 125. The ECU 140 includes a central processing unit (CPU), a read only memory (ROM) and an input-output (I/O) interface. Operation of the electromagnetic valve 10 and the purge valve 125 is controlled by the ECU 140 according to a control program stored in the ROM.

Figure 2:
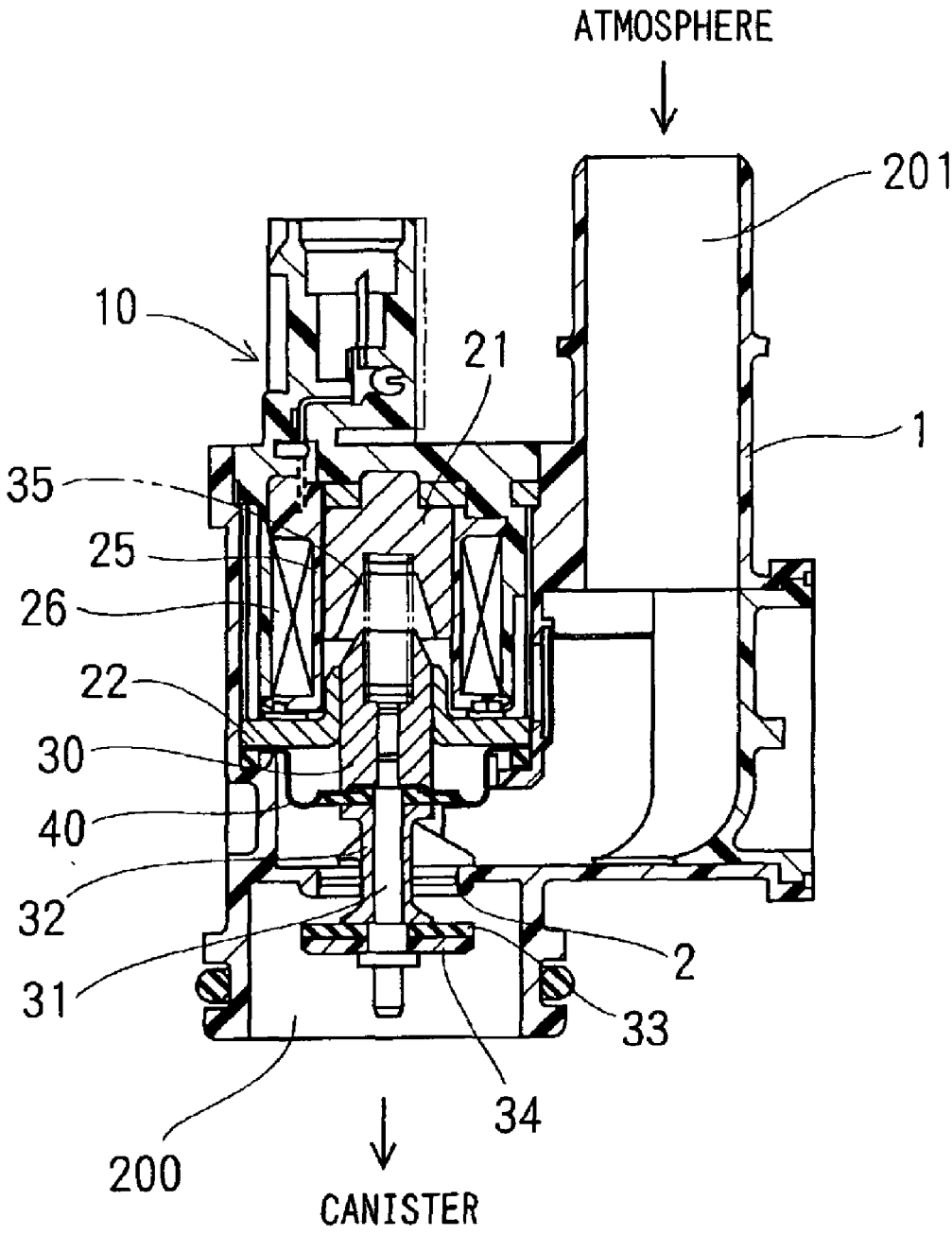
FIG. 2 is a cross-sectional view showing an electromagnetic valve used in the system shown in FIG. 1.

Referring to FIG. 2, a structure and operation of the electromagnetic valve 10 will be described. The electromagnetic valve 10 is housed in a housing 1 that includes an atmospheric port 201 connected to the pipe 112 (shown in FIG. 1) and a canister port 200 connected to the canister 120 (shown in FIG. 1). Communication between the atmospheric port 201 and the canister port 200 is selectively opened or closed by the electromagnetic valve 10.

The electromagnetic valve 10 is composed of a stationary core 21, a supporting member 22, a bobbin 25, a coil 26 wound around the bobbin 25, a movable core 30, shaft 31, a supporting pipe 32, a valve member 33, a resin plate 34, a spring 35, a diaphragm 40 and other associated components. The movable core 30 is slidably supported by the supporting member 22 made of a magnetic material. The valve member 33 made of rubber is sandwiched between the resin plate 34 and the supporting pipe 32. The valve member 33 reciprocally moves together with the movable core 30 and the shaft 31. The spring 35 biases downwardly the movable core 30 so that the valve member 33 is separated from a valve seat 2 formed in the housing 1. The diaphragm 40 made of rubber is sandwiched between the movable core 30 and the supporting pipe 32 at its inner portion, and is firmly fixed between the supporting member 22 and the housing 1 at its outer fringe.

When the electromagnetic valve 10 is turned off (i.e., not energized), the valve member 33 is separated from the valve seat 2 by a biasing force of the spring 35, thereby establishing communication between the atmospheric port 201 and the canister port 200. When the electromagnetic valve 10 is turned on (i.e., energized), the movable core 30 is pulled up toward the stationary core 21 against the biasing force of the spring 35, thereby shutting off the communication between the atmospheric port 201 and the canister port 200.

During a period such as a period in which fuel is being supplied to the fuel tank 100, both of the electronic valve 10 and the purge valve 125 are not energized, i.e., the electromagnetic valve 10 is opened and the purge valve 125 is closed. Accordingly, fuel evaporated in the fuel tank 100 is absorbed to the absorbing material in the canister 120.

During a period in which the engine is operating, the electromagnetic valve 10 is normally opened. Under this condition, when the purge valve 125 is opened, the fuel absorbed in the canister 120 is sucked into the intake pipe 130 of the engine by a negative pressure in the intake pipe 130. In other words, evaporated fuel absorbed in the canister 120 is purged from the evaporated fuel control system and supplied to the engine.

When a predetermined period of time has lapsed after the engine stopped, the pressure leakage in the evaporated fuel control system is detected. The predetermined period of time is a time period in which the engine is cooled down and temperature in the system becomes substantially equal to the atmospheric temperature. For detecting the pressure leakage, communication between the canister 120 and the atmospheric pressure is shut off by closing the electromagnetic valve 10 (i.e., by turning on the electromagnetic valve). In this manner, the system is completely isolated from outside because the purge valve 125 is closed when the engine is not operating.

Under this condition, the pressure in the system is measured by the pressure sensor 106. At the same time, the ambient temperature is measured by the ambient temperature sensor. Electric signals indicating the measured pressure and ambient temperature are fed to the ECU 140. The ECU 140 compares the measured pressure with a predetermined normal pressure corresponding to the measured ambient temperature. The predetermined normal pressure is a pressure which is realized if there is no pressure leakage in the system. Since the predetermined normal pressure depends on the ambient temperature, the measured ambient temperature is used to specify the predetermined normal pressure corresponding to the ambient temperature.

If the measured pressure is lower than the predetermined normal pressure, it is determined that there is a pressure leakage in the system. If the measured pressure reaches the level of the predetermined normal pressure, it is determined that there is no pressure leakage in the system. Then, the electromagnetic valve 10 is turned off (de-energized) to establish communication between the system and the atmosphere.

Figure 3:
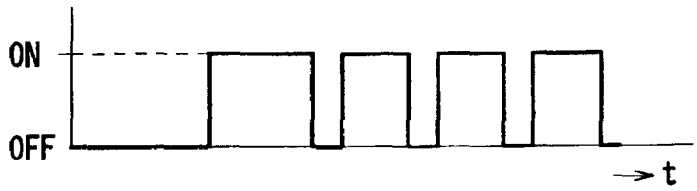
FIG. 3 shows a waveform of a voltage supplied to the electromagnetic valve in a process of detecting pressure leakage in the system.

In the above-described process for detecting the pressure leakage, it is necessary to turn on the electromagnetic valve 10 while the engine is not operating. The electric power for energizing the electromagnetic valve 10 has to be solely supplied from the on-board battery. To reduce the energy consumption, a voltage supplied to the electromagnetic valve 10 is controlled as shown in FIG. 3. That is, a voltage for turning on the electromagnetic valve 10 (for closing the same) is once supplied at a time when the predetermined period of time has lapsed after the engine stopped, and then, the voltage is intermittently supplied in a duty-ratio-controlled manner. The duty-ratio is so controlled that the electromagnetic valve 10 is kept closed by intermittently supplying the voltage. Thus, an average power consumed to energize the electromagnetic valve 10 is reduced.

Figure 4A:
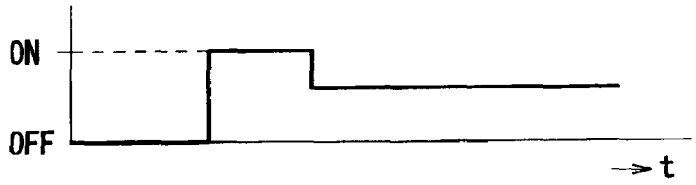
FIGS. 4A–4C show alternative waveforms of the voltage supplied to the electromagnetic valve.
Figure 4B:
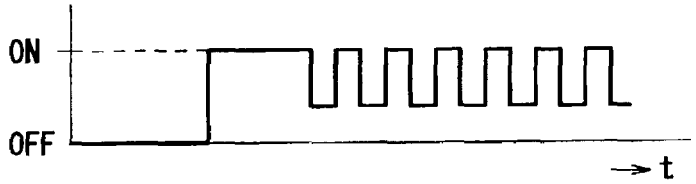
Figure 4C:
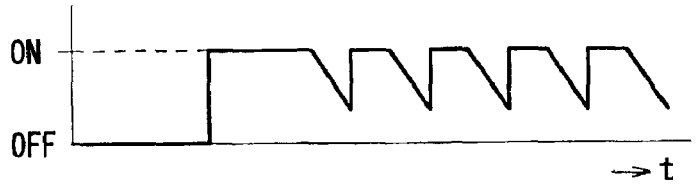

The waveform of the voltage supplied to the electromagnetic valve 10 may be modified to waveforms shown in FIGS. 4A, 4B and 4C. In FIG. 4A, a full voltage for turning on the electromagnetic valve 10 is once supplied, and then, the voltage level is reduced to a lower level that is able to keep the electromagnetic valve 10 at the closed state. In FIG. 4B, after turning on the electromagnetic valve 10 by supplying a full voltage, a voltage, a level of which oscillates between a full level and a lower level, is supplied in a duty-ratio-controlled manner to keep the electromagnetic valve 10 at the closed state. In FIG. 4C, after the full voltage is supplied, a sawtoothed voltage is supplied to keep the electromagnetic valve 10 closed. In any case, the power consumed in the process of detecting the pressure leakage in the evaporated fuel control system can be reduced.

The present invention is not limited to the embodiment described above, but it may be variously modified. For example, instead of measuring the ambient temperature, a temperature in the system may be directly measured by a sensor installed in the system. Though the pressure in the system is measured without pressurizing the inner space of the system in the foregoing embodiment, it is also possible to measure the pressure after the inner space is forcibly pressurized by a pump. Though the electromagnetic valve 10 is positioned at the atmospheric side of the canister 120 in the foregoing embodiment, the electromagnetic valve 10 may be positioned at other places as long as communication between the canister 120 and the atmosphere is selectively switched.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A method of detecting pressure leakage in a system for absorbing fuel evaporated in a fuel tank and for purging the absorbed fuel into an intake pipe of an automotive engine, the system including an electromagnetic valve for controlling communication between the system and an atmospheric pressure, the method comprising steps of:

stopping operation of the engine;

turning on the electromagnetic valve to shut-off communication between the system and the atmospheric pressure;

reducing electric power supplied to the electromagnetic valve after the electromagnetic valve is turned on to a predetermined non-zero power level which is lower than a power supplied for turning on the electromagnetic valve, while keeping the communication between the system and the atmospheric pressure at a shut-off state; and measuring a pressure in the system at the shut-off state and during engine operation stoppage to detect the pressure leakage based on the measured pressure.

2. A method of detecting pressure leakage in a system for absorbing fuel evaporated in a fuel tank and for purging the absorbed fuel into an intake pipe of an automotive engine, the system including an electromagnetic valve for controlling communication between the system and an atmospheric pressure, the method comprising steps of:

stopping operation of the engine;

turning on the electromagnetic valve to shut-off communication between the system and the atmospheric pressure;

reducing electric power supplied to the electromagnetic valve after the electromagnetic valve is turned on while keeping the communication between the system and the atmospheric pressure at a shut-off state;

measuring a pressure in the system at the shut-off state to detect the pressure leakage based on the measured pressure;

measuring an ambient temperature; and comparing the measured pressure with a predetermined normal pressure which is expected in the system having no pressure leakage at the measured ambient temperature.

3. A method of detecting pressure leakage in a system for absorbing fuel evaporated in a fuel tank and for purging the absorbed fuel into an intake pipe of an automotive engine, the system including an electromagnetic valve for controlling communication between the system and an atmospheric pressure, the method comprising steps of:

stopping operation of the engine;

turning on the electromagnetic valve to shut-off communication between the system and the atmospheric pressure;

reducing electric power supplied to the electromagnetic valve after the electromagnetic valve is turned on while keeping the communication between the system and the atmospheric pressure at a shut-off state;

measuring a pressure in the system at the shut-off state to detect the pressure leakage based on the measured pressure;

measuring a temperature in the system; and comparing the measured pressure with a predetermined normal pressure which is expected in the system having no pressure leakage at the measured temperature in the system.

4. A method of detecting pressure leakage in a system for absorbing fuel evaporated in a fuel tank and for purging the absorbed fuel into an intake pipe of an automotive engine, the system including an electromagnetic valve for controlling communication between the system and an atmospheric pressure, the method comprising steps of:

stopping operation of the engine;

turning on the electromagnetic valve to shut-off communication between the system and the atmospheric pressure;

reducing electric power supplied to the electromagnetic valve after the electromagnetic valve is turned on while keeping the communication between the system and the atmospheric pressure at a shut-off state; and measuring a pressure in the system at the shut-off state to detect the pressure leakage based on the measured pressure;

wherein: in the step of reducing electric power supplied to the electromagnetic valve, the electric power is intermittently supplied in a duty-ratio-controlled manner.

5. The detecting method as in claim 1 wherein the pressure is measured after a temperature of the system has stabilized.

6. An apparatus for detecting pressure leakage in a system for absorbing fuel evaporated in a fuel tank and for purging the absorbed fuel into an intake pipe of an automotive engine, the apparatus comprising:

an electromagnetic valve for controlling communication between the system and an atmospheric pressure, the communication between the system and the atmospheric pressure being shut-off when electric power is supplied to the electromagnetic valve;

a controller for stopping operation of the engine, turning on the electromagnetic valve to shut-off communication between the system and the atmospheric pressure, and reducing electric power supplied to the electromagnetic valve after the electromagnetic valve is turned on to a non-zero power level which is lower than a power supplied to the electromagnetic valve for turning on the electromagnetic valve, while keeping the communication between the system and the atmospheric pressure at a shut-off state; and a pressure sensor for measuring a pressure in the system at the shut-off state and during engine operation stoppage to detect the pressure leakage based on the measured pressure.

7. An apparatus for detecting pressure leakage in a system for absorbing fuel evaporated in a fuel tank and for purging the absorbed fuel into an intake pipe of an automotive engine, the apparatus comprising:

an electromagnetic valve for controlling communication between the system and an atmospheric pressure;

a controller for stopping operation of the engine, turning on the electromagnetic valve to shut-off communication between the system and the atmospheric pressure, and reducing electric power supplied to the electromagnetic valve after the electromagnetic valve is turned on while keeping the communication between the system and the atmospheric pressure at a shut-off state; and a pressure sensor for measuring a pressure in the system at the shut-off state and during engine operation stoppage to detect the pressure leakage based on the measured pressure;

a temperature sensor for measuring an ambient temperature;

wherein the pressure measured by the pressure sensor is compared with a predetermined normal pressure which is expected in the system having no pressure leakage at the measured ambient temperature.

8. An apparatus for detecting pressure leakage in a system for absorbing fuel evaporated in a fuel tank and for purging the absorbed fuel into an intake pipe of an automotive engine, the apparatus comprising:

an electromagnetic valve for controlling communication between the system and an atmospheric pressure;

a controller for stopping operation of the engine, turning on the electromagnetic valve to shut-off communication between the system and the atmospheric pressure, and reducing electric power supplied to the electromagnetic valve after the electromagnetic valve is turned on while keeping the communication between the system and the atmospheric pressure at a shut-off state; and a pressure sensor for measuring a pressure in the system at the shut-off state and during engine operation stoppage to detect the pressure leakage based on the measured pressure:

a temperature sensor for measuring a temperature in the system; and wherein the pressure measured by the pressure sensor is compared with a predetermined normal pressure which is expected in the system having no pressure leakage at the measured temperature in the system.

9. An apparatus for detecting pressure leakage in a system for absorbing fuel evaporated in a fuel tank and for purging the absorbed fuel into an intake pipe of an automotive engine, the apparatus comprising:

an electromagnetic valve for controlling communication between the system and an atmospheric pressure;

a controller for stopping operation of the engine, turning on the electromagnetic valve to shut-off communication between the system and the atmospheric pressure, and reducing electric power supplied to the electromagnetic valve after the electromagnetic valve is turned on while keeping the communication between the system and the atmospheric pressure at a shut-off state; and a pressure sensor for measuring a pressure in the system at the shut-off state and during engine operation stoppage to detect the pressure leakage based on the measured pressure;

wherein reducing electric power supplied to the electromagnetic valve comprises intermittently supplying the electric power in a duty-ratio-controlled manner.

10. An apparatus as in claim 6 wherein the pressure is measured by the pressure sensor after a temperature in the system is stabilized.

* * * * *